United States Patent [19]

Gray et al.

[11] 4,399,049

[45] Aug. 16, 1983

BEST AVAILABLE COPY

[54] DETERGENT ADDITIVE COMPOSITIONS

[75] Inventors: Ian Gray, Gosforth; Richard G. Harris, Morpeth, both of England

[73] Assignee: The Procter & Gamble Company, Cincinnati, Ohio

[21] Appl. No.: 362,812

[22] Filed: Mar. 29, 1982

[30] Foreign Application Priority Data

Apr. 8, 1981 [GB] United Kingdom ..... 8111080
Oct. 23, 1981 [GB] United Kingdom ..... 8132014

[51] Int. Cl.[3] ..... C11D 1/66; C11D 3/48; C11D 11/00; C11D 17/06

[52] U.S. Cl. ..... 252/91; 252/8.9; 252/90; 252/95; 252/106; 252/140; 252/174; 252/174.11; 252/174.12; 252/174.13; 252/174.21; 252/186.25; 252/186.38; 252/358; 252/542; 252/543; 252/DIG. 1; 252/DIG. 12

[58] Field of Search ..... 252/91, 95, 174, 174.13, 252/174.21, 8.9, 90, 106, 135, 174.11, 174.12, 186.25, 186.38, 358, 542, 543

[56] References Cited

U.S. PATENT DOCUMENTS

| | | | |
|---|---|---|---|
| 4,020,015 | 4/1977 | Bevan | 252/544 |
| 4,087,368 | 5/1978 | Borrello | 252/132 |
| 4,242,219 | 12/1980 | Bogerman | 252/174.12 |
| 4,290,903 | 9/1981 | MacGilp et al. | 252/91 |

FOREIGN PATENT DOCUMENTS

| | | |
|---|---|---|
| 1204123 | 9/1970 | United Kingdom . |
| 1303479 | 1/1973 | United Kingdom . |
| 1395006 | 5/1975 | United Kingdom . |

*Primary Examiner*—Dennis L. Albrecht
*Attorney, Agent, or Firm*—Robert B. Aylor; Richard C. Witte; Thomas H. O'Flaherty

[57] ABSTRACT

A detergent additive composition in the form of an extrudate comprising about 75% to about 95% of particulate infusible solids comprising storage-sensitive detergent-additive material and about 5% to about 25% of ethoxylated nonionic surfactant. The storage-sensitive detergent additive material is preferably an organic peroxy acid bleach precursor. When added to detergent compositions, the additive compositions have excellent storage stability and water-dispersibility characteristics.

17 Claims, No Drawings

DETERGENT ADDITIVE COMPOSITIONS

TECHNICAL FIELD

The Present invention relates to detergent additive compositions, methods for making thereof, and use thereof in granular detergent compositions. In particular, it relates to detergent additive compositions having improved storage stability within a full detergent composition.

BACKGROUND OF THE INVENTION

It is widely recognized that the function of a detergent additive material can be significantly impaired in a detergent composition by interaction between the additive material and other components of the composition. For example, enzymes, perfumes and bleach activators can be deleteriously effected by interaction with peroxy bleaches; cationic fabric conditioners can be deleteriously effected by interaction with anionic surfactants; and fluorescers can be deleteriously effected by interaction with peroxy bleaches or cationic surfactants. Moreover, the consumer acceptibility of a product can also be significantly reduced as the result of physical interactions between a detergent additive and other components of a detergent composition. For instance, a speckled detergent containing a water-soluble dye can lose its aesthetic appeal as a result of migration of the dye into the detergent base powder, an effect which can be significantly enhanced by the presence in the detergent composition of a nonionic surfactant component. Physical segregation problems in the case of abnormally-sized additive materials can also contribute to reduce aesthetic appeal and effectiveness of a detergent composition.

Numerous attempts have been made, of course, to improve the storage-stability characteristics of detergent additive materials such as bleach activators and the like, but such attempts have in general encountered only limited success. The main approach to the problem has been to protect the additive material from its hostile environment by agglomerating, coating or encapsulating the material with a non-hygroscopic, preferably hydrophobic material. Conventionally, organic materials have found the greatest favour as coating agents because such materials readily form a substantially cohesive and continuous plastic matrix in which the additive material can be embedded. British Patent Nos. 1,204,123, 1,441,416, and 1,395,006 are representative of this general approach. Unfortunately, however, protection of sensitive ingredients within an organic plastic matrix as practiced in the art can have a detrimental effect on the dispersibility or dissolution characteristics of the ingredient in water. This is of particular significance in the case of bleach activators because poor dispersibility can lead directly to problems of "pinpoint spotting" and fabric damage.

Accordingly, the present invention provides detergent additive compositions having improved storage stability together with excellent release and dispersibility characteristics in wash water. In particular, it provides detergent additive compositions comprising bleach activators which are stable to storage in bleach-containing detergent compositions but which disperse readily in water to provide effective low temperature bleaching performance. The invention also provides detergent additive compositions having improved physical and processing characteristics.

SUMMARY OF THE INVENTION

According to the present invention, there is provided a detergent additive composition in the form of an extrudate comprising by weight thereof:

(a) from about 75% to about 95% of particulate, infusible solids having a particle size distribution such that at least about 50% thereof passes a 250 micrometer screen and comprising storage-sensitive detergent additive material, and (b) from about 5% to about 25% of ethoxylated nonionic surfactant melting in the range from about 20° C. to about 60° C., the composition being prepared by mixing the particulate infusible solids and ethoxylated nonionic surfactant in liquid form to form a substantially homogeneous friable mass, and mechanically extruding the friable mass by means of a screw with radial discharge through an apertured screen to form extrudate in the form of elongate particles having an average lateral dimension in the range from 0.5 millimeters to 2 millimeters, and an average longitudinal dimension in the range from about 1 mm to about 6 mm.

With regard to the solids component, this has a particle size distribution such that at least about 50%, more preferably at least about 80% thereof passes a 250 micrometer screen. Highly preferred solid materials have a particle size distribution such that at least about 50%, especially at least about 80% thereof passes a 150 micrometer or even a 100 micrometer screen. The particulate solids are described herein as "infusible" by which is meant that in the anhydrous form, they melt at temperatures in excess of about 100° C. and preferably in excess of about 150° C. The particulate solids component can consist essentially completely of a storage-sensitive detergent additive material, or it can consist of a mixture of storage-sensitive additive material with a particulate diluent or dispersant as described below.

In preferred compositions, the extrudate comprises from about 80% to about 92%, preferably from about 84% to about 90% particulate solids, and from about 8% to about 20%, more preferably from about 10% to about 16% of ethoxylated nonionic surfactant. A solids level of 84% to 90% and a surfactant level of 10% to 16% is particularly desirable for detergent additive materials or diluents having a melting point of about 150° C. or higher. Detergent additive materials having lower melting point (about 100° C. to about 145° C.) may require higher nonionic surfactant levels for optimum processing and this tends to lead to reduced water-dispersibility. Accordingly, it is preferred to use low melting detergent additive materials in combination with at least 5%, more preferably at least 10% of high melting diluent.

Control of the particle size of the extrudate itself is also of importance for securing optimum storage stability and release characteristics. Preferably, the extrudate has a particle size distribution such that at least 50%, more preferably at least 80% thereof passes a 2 millimeter screen onto a 500 micrometer screen. Highly preferred extrudates have a particle size distribution such that at least 50%, especially at least 80% thereof passes a 1.4 millimeter screen onto a 840 micrometer screen. It is a noteable feature of the present invention that extrudates having these optimum particle sizes can be produced directly by extrusion without requiring a post-extrusion sizing step such as cutting, seiving or spheronizing and with minimum or no need for recycling waste material. Some mechanical agitation of the particles after extrusion may be desirable however, for optimum size control.

The ethoxylated nonionic surfactant component of the present composition has a melting point in the range from about 20° C. to about 60° C., preferably from about 22° C. to about 40° C., more preferably from about 25° C. to about 36° C. Highly suitable nonionic surfactants of this type are ethoxylated primary or secondary $C_9$–$C_{18}$ alcohols having an average degree of ethoxylation from about 3 to about 30, more preferably from about 5 to about 14.

Turning to the storage-sensitive detergent additive material, this can be a unifunctional or multifunctional material selected from bleaching auxiliaries, photoactivators, fluorescers, dyes, perfumes, germicides, enzymes, suds controllers, fabric conditioners and the like. Highly preferred detergent additive materials, however, are organic peroxyacid bleach precursors, sometimes called herein bleach activators. Another highly preferred detergent additive material is a porphine-type photoactivator discussed in more detail below.

As mentioned earlier, the detergent additive material can be in admixture with a particulate diluent or dispersant.

Suitable dispersants herein include water-insoluble natural or synthetic silica or silicates, water-soluble inorganic salt materials and water-soluble organic polyacids or salts thereof having a melting point (anhydrous) of at least 100° C., preferably at least about 150° C.

In general terms, the detergent additive compositions herein are made by (a) mixing the particulate infusible solids comprising storage-sensitive detergent additive material and liquid ethoxylated nonionic surfactant to form a substantially homogeneous, friable mass, and (b) mechanically extruding the friable mass.

By "friable" is meant that the mixture of particulate solids and liquid ethoxylated nonionic surfactant prior to extrusion has a moist, somewhat crumbly texture. This is to be contrasted with the cohesive, plastic state which forms at higher ratios of nonionic surfactant:total solids.

As specified herein, the friable mixture of solids and nonionic surfactant is mechanically extruded by means of a screw with radial discharge through an apertured screen to form extrudate in the form of elongate particles having an average lateral dimension in the range from about 500 micrometers to about 2 millimeters, preferably from about 840 micrometers to about 1.4 millimeters, and an average longitudinal dimension in the range from about 1 millimeter to about 6 millimeters, preferably from about 1.5 millimeters to about 3 millimeters. Preferably, the particles have an average longitudinal:average lateral dimension ratio of from about 1.1:1 to about 3:1, more preferably from 1.3:1 to about 1.8:1. In this context, "average" refers to a simple number-average.

The present invention further provides granular detergent compositions containing the detergent additive compositions described herein. Preferred granular detergent compositions comprise:

(a) from about 40% to about 99.9% of spray-dried powder comprising (i) from about 1% to about 20% of organic surfactant selected from anionic, zwitterionic and ampholytic surfactants and mixtures thereof, (ii) from about 5% to about 93.9% of detergency builder, and (iii) from about 5% to about 18% moisture, (b) from about 0.1% to about 20% of the detergent additive composition, and optionally (c) up to about 25% of ethoxylated nonionic surfactant in intimate mixture with the spray-dried base powder and detergent additive composition, and (d) up to about 35% by weight of peroxysalt bleaching agent The individual components of the instant compositions will now be discussed in detail.

A preferred class of detergent additive material is an organic peroxyacid bleach precursor. Examples of the various classes of peroxyacid bleach precursors include:

(a) Esters

Esters suitable as peroxy compound precursors in the present invention include esters of monohydric substituted and unsubstituted phenols, substituted aliphatic alcohols in which the substituent group is electron withdrawing in character, mono- and disaccharides, N-substituted derivatives of hydroxylamine and esters of imidic acids. The phenol esters of both aromatic and aliphatic mono- and dicarboxylic acids can be employed. The aliphatic esters can have 1 to 20 carbon atoms in the acyl group, examples being phenyl laurate, phenyl myristate, phenyl palmitate and phenyl stearate. Of these, 1-acetoxy benzoic acid and methyl o-acetoxy benzoate are especially preferred. Diphenyl succinate, diphenyl azeleate and diphenyl adipate are examples of phenyl aliphatic dicarboxylic acid esters. Aromatic esters include phenyl benzoate, diphenyl phthalate and diphenyl isophthalate.

A specific example of an ester of a substituted aliphatic alcohol is trichloroethyl acetate. Examples of saccharide esters include glucose penta-acetate and sucrose octa-acetate. An exemplary ester of hydroxylamine is acetyl aceto hydroxamic acid.

These and other esters suitable for use as peroxy compound precursors in the present invention are fully described in British patent specification Nos. 836988 and 1147871.

A further group of esters are the acyl phenol sulphonates and acyl alkyl phenol sulphonates. An example of the former is sodium acetyl phenol sulphonate (alternatively described as sodium p-acetoxy benzene sulphonate). Examples of acyl alkyl phenol sulphonates include sodium 2-acetoxy 5-dodecyl benzene sulphonate, sodium 2-acetoxy 5-hexyl benzene sulphonate and sodium 2-acetoxy capryl benzene sulphonate. The preparation and use of these and analogous compounds is given in British patent specification Nos. 963135 and 1147871.

Esters of imidic acids have the general formula:

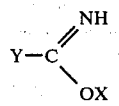

wherein X is substituted or unsubstituted $C_1$—$C_{20}$ alkyl or aryl and Y can be the same as X and can also be —$NH_2$. An example of this class of compounds is ethyl benzimidate wherein Y is $C_6H_5$ and X is ethyl.

Other specific esters include p-acetoxy acetophenone and 2,2-di-(4-hydroxyphenyl)propane diacetate. This last material is the diacetate derivative of 2,2-di(4-hydroxyphenyl)propane more commonly known as Bisphenol A which is an intermediate in the manufacture of polycarbonate resins. Bisphenol A diacetate and methods for its manufacture are disclosed in German DAS No. 1260479 published February 8th, 1968 in the name of VBB Chemiefaserwork Schwarza "Wilhelm Piesh".

(b) Imides

Imides suitable as organic peroxy compound precursors in the present invention are compounds of formula:

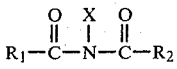

in which $R_1$ and $R_2$, which can be the same or different are independently chosen from a $C_1$–$C_4$ alkyl group or an aryl group and X is an alkyl, aryl or acyl radical (either carboxylic or sulphonic). Typical compounds are those in which $R_1$ is a methyl, ethyl, propyl or phenyl group but the preferred compounds are those in which $R_2$ is also methyl, examples of such compounds being N,N-diacetylaniline, N,N-diacetyl-p-chloroaniline and N,N-diacetyl-p-toluidine. Either one of $R_1$ and $R_2$ together with X may form a heterocyclic ring containing the nitrogen atom. An illustrative class having this type of structure is the N-acyl lactams, in which the nitrogen atom is attached to two acyl groups, one of which is also attached to the nitrogen in a second position through a hydrocarbyl linkage. A particularly preferred example of this class is N-acetyl caprolactam. The linkage of the acyl group to form a heterocyclic ring may itself include a heteroatom, for example oxygen, and N-acyl saccharides are a class of precursors of this type.

Examples of cyclic imides in which the reactive centre is a sulphonic radical are N-benzene sulphonyl phthalimide, N-methanesulphonyl succinimide and N-benzene sulphonyl succinimide. These and other N-sulphonyl imides useful herein are described in British patent specification No. 1242287.

Attachment of the nitrogen atoms to three acyl groups occurs in the N-acylated dicarboxylic acid imides such as the N-acyl phthalimides, N-acyl succinimides, N-acyl adipimides and N-acyl glutarimides. Imides of the above-mentioned types are described in British patent specification No. 855735 the disclosures of which are hereby incorporated specifically herein by reference.

Two further preferred groups of materials in this class are those in which X in the above formula is either a second diacylated nitrogen atom i.e. substituted hydrazines, or a difunctional hydrocarbyl groups such as a $C_1$–$C_6$ alkylene group further substituted with a diacylated nitrogen atom i.e. tetra acylated alkylene diamines.

Particularly preferred compounds are N,N,N′,N′-tetra acetylated compounds of formula:

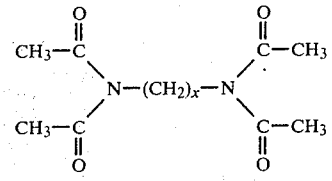

in which x can be 0 or an integer between 1 and 6, examples are tetra acetyl methylene diamine (TAMD) where x=1, tetra acetyl ethylene diamine (TAED) where x=2, and tetra acetyl hexamethylene diamine (TAHD) where x=6. Where X=0 the compound is tetra acetyl hydrazine (TAH). These and analogous compounds are described in British patent specification Nos. 907,356, 907,357,and 907,358.

Acylated glycourils form a further group of compounds falling within the general class of imide peroxy compound precursors. These materials have the general formula:

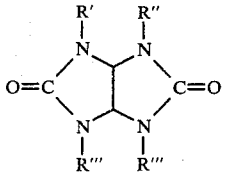

in which at least two of the R groups represent acyl radicals having 2 to 8 carbon atoms in their structure. The preferred compound is tetra acetyl glycouril in which the R groups are all $CH_3CO$— radicals. The acylated glycourils are described in British patent specification Nos. 1246338, 1246339, and 1247429.

Other imide-type compounds suitable for use as peroxy compound precursors in the present invention are the N-(halobenzoyl) imides disclosed in British patent specification No. 1247857, of which N-m-chloro benzoyl succinimide is a preferred example, and poly imides containing an N-bonded-COOR group, e.g. N-methoxy carbonyl phthalimide, disclosed in British patent specification No. 1244200.

N-acyl and N,N′-diacyl derivatives of urea are also useful peroxy compound precursors for the purposes of the present invention, in particular N-acetyl dimethyl urea, N,N′-diacetyl ethylene urea and N,N′-diacetyl dimethyl urea. Compounds of this type are disclosed in Netherlands Patent Application No. 6504416 published 10th October, 1966. Other urea derivatives having inorganic persalt activating properties are the mono- or di-N-acylated azolinones disclosed in British patent specification No. 1379530.

Acylated hydantoin derivatives also fall within this general class of organic peroxy compound precursors. The hydantoins may be substituted e.g. with lower alkyl groups and one or both nitrogen atoms may be acylated. Examples of compounds of this type are N-acyl hydantoin, N,N-diacetyl, 5,5-dimethyl hydantoin, 1-phenyl, 3-acetyl hydantoin and 1-cyclohexyl, 3-acetyl hydantoin. These and similar compounds are described in British patent specification Nos. 965672 and 1112191.

Another class of nitrogen compounds of the imide type are the N,N-diacetyl methylene diformamides of which N,N-diacetyl methylamine diformamide is the preferred member. This material and analogous compounds are disclosed in British patent specification No. 1106666.

(c) Imidazoles

N-acyl imidazoles and similar five-membered ring systems form a further series of compounds useful as inorganic peroxy compound precursors. Specific examples are N-acetyl benzimidazole, N-benzoyl imidazole and its chloro- and methyl-analogues. Compounds of this type are disclosed in British patent specification Nos. 1234762, 1311765 and 1395760.

(d) Oximes

Oximes and particularly acylated oximes are also a useful class of organic peroxy compound precursors for the purpose of this invention. Oximes are derivatives of hydroxylamine from which they can be prepared by reaction with aldehydes and ketones to give aldoximes and ketoximes respectively. The acyl groups may be $C_1$–$C_{12}$ aliphatic or aromatic in character, preferred acyl groups being acetyl, propionyl, lauroyl, myristyl and benzoyl. Compounds containing more than one carbonyl group can react with more than one equivalent of hydroxylamine and the commonest class of dioximes are those derived from 1,2-diketones and ketonic aldehydes, such as dimethyl glyoxime

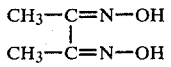

The acylated derivatives of this compound are of particular value as organic peroxy compound precursors, examples being diacetyl dimethyl glyoxime, dibenzoyl dimethyl glyoxime and phthaloyl dimethyl glyoxime.

(e) Carbonates

Substituted and unsubstituted aliphatic, aromatic and alicyclic esters of carbonic and pyrocarbonic acid have also been proposed as organic peroxy compound precursors. Typical examples of such esters are p-carboxy phenyl ethyl carbonate, sodium-p-sulphophenyl ethyl carbonate, sodium-p-sulphophenyl n-propyl carbonate and diethyl pyrocarbonate. The use of such esters as inorganic persalt activators in detergent compositions is set forth in British patent specification No. 970950.

In addition to the foregoing classes, numerous other materials can be utilised as organic peroxy compound percursors including triacyl guanidines of formula:

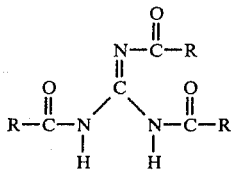

wherein R is alkyl, preferably acetyl or phenyl, prepared by the acylation of guanidine salt. Other classes of compounds include acyl sulphonamides, e.g. N-phenyl N-acetyl benzene sulphonamide as disclosed in British patent specification No. 1003310 and triazine derivatives such as those disclosed in British patent specification Nos. 1104891 and 1410555. Particularly preferred examples of triazine derivatives are the di- and triacetyl derivatives of 2,4,6,-trihydroxy-1,3,5-triazine, 2-chloro-4,6-dimethoxy-S-triazine and 2,4-dichloro 6-methoxy-S-triazine. Piperazine derivatives such as 1,4-diacylated 2,5-diketo piperazine as described in British patent specification Nos. 1339256 and 1339257 are also useful as are water-soluble alkyl and aryl chloroformates such as methyl, ethyl and phenyl chloroformate disclosed in British patent specification No. 1242106.

Of the foregoing classes of activators, the preferred classes are those that produce a peroxycarboxylic acid on reaction with an inorganic persalt. In particular the preferred classes are the imides, oximes and esters especially the phenol esters and imides.

Specific preferred materials are solid and are incorporated in the instant compositions in finely divided form, i.e., with an average particle size of less than about 500μ, more preferably less than about 250μ, especially less than about 150μ. Highly preferred materials include methyl o-acetoxy benzoate, sodium-p-acetoxy benzene sulphonate, Bisphenol A diacetate, tetra acetyl ethylene diamine, tetra acetyl hexamethylene diamine and tetra acetyl methylene diamine.

The invention is especially suited to the stabilization of multifunctional photoactivator/dyes belonging to the porphine class of general formula

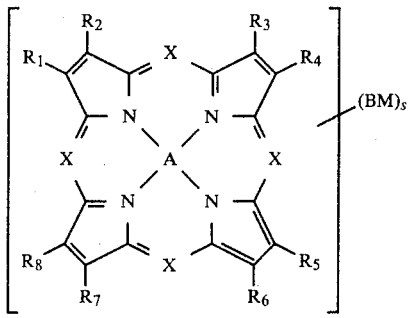

wherein each X is (=N—) or (=CY—), and the total number of (=N—) groups is 0, 1, 2, 3 or 4; wherein each Y, independently, is hydrogen or meso substituted alkyl, cycloalkyl, aralkyl, aryl, alkaryl or heteroaryl; wherein each R, independently, is hydrogen or pyrrole substituted alkyl, cycloalkyl, aralkyl, aryl, alkaryl or heteroraryl, or wherein adjacent pairs of R's are joined together with orthoarylene groups to form pyrrole substituted alicyclic or heterocyclic rings; wherein A is 2(H) atoms bonded to diagonally opposite nitrogen atoms, or Zn(II), Cd(II), Mg(II), Ca(II), Al(III), Sc(III), or Sn(IV); wherein B is an anionic, nonionic or cationic solubilizing group substituted into Y or R; wherein M is a counterion to the solubilizing groups; and wherein s is the number of solubilizing groups; wherein, when B is cationic, M is an anion and s is from 1 to 8; when B is nonionic, B is polyethoxylate, M is zero, s is from 1 to 8, and the number of condensed ethylene oxide molecules per prophine molecule is from 8 to 50; when B is anionic and proximate, M is cationic and s is from 3 to 8; when B is anionic and remote, M is cationic and s is from 2 to 8; and when B is sulphonate the number of sulphonate groups is no greater than the number of aromatic and heterocyclic substituent groups.

As used herein, a solubilizing group attached to a carbon atom displaced more than 5 carbon atoms away from the porphine core is referred to as "remote"; otherwise it is "proximate."

Highly preferred materials of this general type are the zinc phthalocyanine tri- and tetrasulphonates and mixtures thereof. Materials of this general class were originally disclosed for use in detergent compositions in British Pat. Nos. 1,372,035 and 1,408,144 and are discussed in detail in European Patent Application 3861. The photo-activators can provide fabric bleaching effects in built detergent compositions in the presence of visible light and atmospheric oxygen and can also synergistically enhance the bleaching effect of conventional bleaching agents such as sodium perborate. The porphine bleach is preferably used in an amount such that the level of porphine in final detergent composition is in the range from about 0.001% to about 0.5%, more preferably from about 0.002% to about 0.02%, especially from about 0.003% to about 0.01% by weight.

The porphine is preferably incorporated into the detergent additive composition as an intimate mixture with a hydratable water-soluble crystalline salt, especially tetrasodium tripolyphosphate hydrated to an extent of about 55% to about 65% of its maximum hydration capacity. The additive composition will preferably comprise from about 0.05% to 2%, more preferably from about 0.1% to 0.5% by weight of porphine.

The invention can also be applied to give improved additive compositions based on enzymes, fluorescers, perfumes, suds suppressors, fabric conditioners, soil suspending agents, peroxyacid bleaches and the like.

Preferred enzymatic materials include the commercially available amylases and neutral and alkaline proteases conventionally incorporated into detergent compositions. Suitable enzymes are discussed in U.S. Pat. Nos. 3,519,570 and 3,533,139. Examples of suitable enzymes include the materials sold under the Registered Trade Marks Maxatase and Alcalase.

Anionic fluorescent brightening agents are well-known materials, examples of which are disodium 4,4'-bis-(2-diethanolamino-4-anilino-s-triazin-6-ylamino)stilbene-2:2'disulphonate, disodium 4,4'-bis-(2-morpholino-4-anilino-s-triazin-6-ylaminostilbene-2:2'-disulphonate, disodium 4,4'-bis-(2,4-dianilino-s-triazin-6-ylamino)stilbene-2:2'-disulphonate, disodium 4,4'-bis-(2-anilino-4-(N-methyl-N-2-hydroxyethylamino)-s-triazin-6-ylamino)stilbene-2,2'-disulphonate, disodium 4,4'-bis-(4-phenyl-2,1,3-triazol-2-yl)-stilbene-2,2'-disulphonate, disodium 4,4'-bis(2-anilino-4-(1-methyl-2-hydroxyethylamino)-s-triazin-6-ylamino)stilbene-2,2'disulphonate and sodium 2(stilbyl-4''-(naptho-1',2':4,5)-1,2,3-triazole-2''-sulphonate.

Other fluorescers to which the invention can be applied include the 1,3-diaryl pyrazolines and 7-alkylaminocoumarins.

With regard to the ethoxylated nonionic surfactant component, this can be broadly defined as compounds produced by the condensation of ethylene oxide groups (hydrophilic in nature) with an organic hydrophobic compound, which may be aliphatic or alkyl aromatic in nature. The length of the polyoxyethylene group which is condensed with any particular hydrophobic group can be readily adjusted to yield a water-soluble compound having the desired degree of balance between hydrophilic and hydrophobic elements.

Examples of suitable nonionic surfactants include:

1. The polyethylene oxide condensates of alkyl phenol, e.g. the condensation products of alkyl phenols having an alkyl group containing from 6 to 12 carbon atoms in either a straight chain or branched chain configuration, with ethylene oxide, the said eithylene oxide being present in amounts equal to 3 to 30, preferable 5 to 14 moles of ethylene oxide per mole of alkyl phenol. The alkyl substituent in such compounds may be derived, for example, from polymerised propylene, di-isobutylene, octene and nonene. Other examples include dodecylphenol condensed with 9 moles of ethylene oxide per mole of phenol; dinonylphenol condensed with 11 moles of ethylene oxide per mole of phenol; nonylphenol and di-isooctylphenol condensed with 13 moles of ethylene oxide.

2. The condensation product of primary or secondary aliphatic alcohols having from 8 to 24 carbon atoms, in either straight chain or branched chain configuration, with from 3 to about 30 moles, preferably 5 to about 14 moles of ethylene oxide per mole of alcohol. Preferably, the aliphatic alcohol comprises between 9 and 18 carbon atoms and is ethoxylated with between 3 and 30, desirably between 5 and 14 moles of ethylene oxide per mole of aliphatic alcohol. The preferred surfactants are prepared from primary alcohols which are either linear (such as those derived from natural fats or, prepared by the Ziegler process from ethylene, e.g. myristyl, cetyl, stearyl alcohols), or partly branched such as the Dobanols and Neodols which have about 25% 2-methyl branching (Dobanol and Neodol being Trade Names of Shell or Synperonics, which are understood to have about 50% 2-methyl branching (Synperonic is a Trade Name of I.C.I.) or the primary alcohols having more than 50% branched chain structure sold under the Trade Name Lial by Liquichimica. Specific examples of nonionic surfactants falling within the scope of the invention include Dobanol 45-4, Dobanol 45-7, Dobvanol 45-9, Dobanol 91-3, Dobanol 91-6, Dobanol 91-8, Synperonic 6, Synperonic 14, the condensation products of coconut alcohol with an average of between 5 and 12 moles of ethylene oxide per mole of alcohol, the coconut alkyl portion having from 10 to 14 carbon atoms, and the condensation products of tallow alcohol with an average of between 7 and 12 moles of ethylene oxide per mole of alcohol, the tallow portion comprising essentially between 16 and 22 carbon atoms. Secondary linear alkyl ethoxylates are also suitable in the present compositions, especially those ethoxylates of the Tergitol series having from about 9 to 15 carbon atoms in the alkyl group and up to about 11, especially from about 3 to 9, ethoxy residues per molecule.

3. The compounds formed by condensing ethylene oxide with a hydrophobic base formed by the condensation of propylene oxide with propylene glycol. The molecular weight of the hydrophobic portion generally falls in the range of about 1500 to 1800. Such synthetic nonionic detergents are available on the market under the Trade Name of "Pluronic" supplied by Wyandotte Chemicals Corporation.

Various optional ingredients can be incorporated into the additive and detergent compositions of the present invention in order to increase efficacy, particularly in the area of detergency and stain removal. The total amount of such optional ingredients lies in the range 1%–70%, preferably 1%–30% of the additive composition when incorporated directly therein, or in the range 40%–99.9%, preferably 90%–99.5% when incorporated in the non-additive portion of a detergent composition.

The detergent additive compositions of the invention can include a particulate dispersant, either in intimate mixture with the detergent additive material, or more preferably as a surface-coating agent on the extrudate at a level of from about 1% to 3%, especially from about 1.1% to 2.5% by weight of the composition. The dispersant is preferably a water-insoluble silica or silicate, a water-soluble inorganic salt, or an organic polyacid or salt thereof. Water-insoluble silicates can be selected from aluminosilicates of the clay or zeolite classes or can be a magnesium silicate type of material. Aluminosilicates of the clay variety are preferably sheet-like natural clays, especially those selected from the smectite-type and kaolinite-type groups. Highly suitable smectite-type clays include alkali and alkaline-earth metal montmorillonites, saponites and hectorites; highly suitable kaolinite-type materials include kaolinite itself, calcined kaolin and metakaolin.

Other suitable water-insoluble silicates include aluminosilicates of the zeolite type, particularly those of the general formula $Na_z(AlO_2)_z(SiO_2)_yxH_2O$ wherein z and y are integers of at least about 6, the molar ratio of z to y is in the range from about 1.0 to about 0.5 and x is a number such that the moisture content of the aluminosilicate is from about 10% to about 28% by weight thereof. Particularly preferred materials of the zeolite class are those prepared from clay themselves, especially A-type zeolites prepared by alkali treatment of calcined kaolin.

Another suitable water-insoluble silicate is a magnesium silicate of formula n $MgO:SiO_2$ wherein n is in the range from about 0.25 to about 4.0.

Suitable water-soluble inorganic salts include magnesium sulphate or chloride, sodium bicarbonate as well as the calcium or magnesium complexing agents useful as detergency builders. These are discussed in detail below.

Suitable organic acids include lactic acid, glycollic acid and ether derivatives thereof as disclosed in Belgium Patents Nos. 821,368, 821,369 and 821,370; succinic acid, malonic acid, (ethylenedioxy) diacetic acid, maleic acid, diglyollic acid, tartaric acid, tartronic acid and fumaric acid; citric acid, aconitic acid, citraconic acid, carboxymethyloxy succinic acid, lactoxysuccinic acid, and 2-oxa-1,1,3-propane tricarboxylic acid; oxydisuccinic acid, 1,1,2,2-ethane tetracarboxylic acid, 1,1,3,3-propane tetracarboxylic acid, and 1,1,2,3-propane tetracarboxylic acid; cyclopentane-cis, cis, cis-tetracarboxylic acid, cyclopentadienide pentacarboxylic acid, 2,3,4,5-tetrahydrofuran-cis, cis, cis-tetracarboxylic acid, 2,5-tetrahydrofuran-cis-cis dicarboxylic acid, 1,2,3,4,5,6-hexane-hexacarboxylic acid, mellitic acid, pyromellitic acid and the phthalicacid derivatives disclosed in British Patent 1,425,343; ethylene diamine tetra(methylenephosphonic acid), diethylene triamine penta(methylenephosphonic acid) and the acid salts of the above organic acids. Of the above, the preferred organic acids are citric, glycollic and lactic acids and the two phosphonic acids.

As well as being a dispersant, the above acidic materials also have a pH regulating function, of course, and this can be particular valuable in the case of extrudate containing bleach activators.

A highly preferred ingredient of the detergent compositions of the invention is a surfactant or mixture of surfactants, especially an anionic surfactant or a mixture thereof with nonionic, cationic, zwitterionic and ampholytic surfactant. The surfactant is preferably present in the non-additive portion of the composition at a level of from about 1% to about 20%, more preferably from about 3% to about 16% of the total composition. A typical listing of the classes and species of these surfactants is given in U.S. Pat. No. 3,663,961 issued to Norris on May 23, 1972 and incorporated herein by reference.

Suitable synthetic anionic surfactants are water-soluble salts of alkyl benzene sulfonates, alkyl sulfates, alkyl polyethoxy ether sulfates, paraffin sulfonates, alphaolefin sulfonates, alpha-sulfo-carboxylates and their esters, sulfonates, alpha-sulfo-carboxylates and their esters, alkyl glyceryl ether sulfonates, fatty acid monoglyceride sulfates and sulfonates, alkyl phenol polyethoxy ether sulfates, 2-acyloxy-alkane-1-sulfonate, and beta-alkyloxy alkane sulfonate.

A particularly suitable class of anionic surfactants includes water-soluble salts, particularly the alkali metal, ammonium and alkanolammonium salts or organic sulfuric reaction products having in their molecular structure an alkyl or alkaryl group containing from about 8 to about 22, especially from about 10 to about 20 carbon atoms and a sulfonic acid or sulfuric acid ester group. (Included in the term "alkyl" is the alkyl portion of acyl groups). Examples of this group of synthetic detergents which form part of the detergent compositions of the present invention are the sodium and potassium alkyl sulfates, especially those obtained by sulfating the higher alcohols ($C_{8-18}$) carbon atoms produced by reducing the glycerides of tallow or coconut oil and sodium and potassium alkyl benzene sulfonates, in which the alkyl group contains from about 9 to about 15, especially about 11 to about 13, carbon atoms, in straight chain or branched chain configuration, e.g. those of the type described in U.S. Pat. No. 2,220,099 and 2,477,383 and those prepared from alkylbenzenes obtained by alkylation with straight chain chloroparaffins (using aluminium trichloride catalysis) or straight chain olefins (using hydrogen fluoride catalysis). Especially valuable are linear straight chain alkyl benzene sulfonates in which the average of the alkyl group is about 11.8 carbon atoms, abbreviated as $C_{11.8}$ LAS.

Other anionic detergent compounds herein include the sodium $C_{10-18}$ alkyl glyceryl ether sulfonates, especially those ethers of higher alcohols derived from tallow and coconut oil; sodium coconut oil fatty acid monoglyceride sulfonates and sulfates; and sodium or potassium salts of alkyl phenol ethylene oxide ether sulfate containing about 1 to about 10 units of ethylene oxide per molecule and wherein the alkyl groups contain about 8 to about 12 carbon atoms.

Other useful anionic detergent compounds herein include the water-soluble salts or esters of $\alpha$-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; alkyl ether sulfates containing from about 10 to 18, especially about 12 to 16, carbon atoms in the alkyl group and from about 1 to 12, especially 1 to 6, more especially 1 to 4 moles of ethylene oxide; water-soluble salts of olefin sulfonates containing from about 12 to 24, preferably about 14 to 16, carbon atoms, especially those made by reaction with sulfur trioxide followed by neutralization under conditions such that any sultones present are hydrolysed to the corresponding hydroxy alkane sulfonates; water-soluble salts of paraffin sulfonates containing from about 8 to 24, especially 14 to 18 carbon atoms, and $\beta$-alkyloxy alkane sulfonates containing from about 1 to 3 carbon atoms in the alkyl group and from about 8 to 20 carbon atoms in the alkane moiety.

The alkane chains of the foregoing non-soap anionic surfactants can be derived from natural sources such as coconut oil or tallow, or can be made synthetically as for example using the Ziegler or Oxo processes. Water solubility can be achieved by using alkali metal, ammonium or alkanolammonium cations; sodium is preferred. Magnesium and calcium are preferred cations under circumstances described by Belgian patent No. 843,636 invented by Jones et al, issued Dec. 30, 1976. Mixtures of anionic surfactants are contemplated by this invention; a preferred mixture contains alkyl benzene sulfonate having 11 to 13 carbon atoms in the alkyl group or paraffin sulfonate having 14 to 18 carbon atoms and either an alkyl sulfate having 8 to 18, preferably 12 to 18, carbon atoms in the alkyl group, or an alkyl polyethoxy alcohol sulfate having 10 to 16 carbon atoms in the alkyl group and an average degree of ethoxylation of 1 to 6.

Nonionic surfactants suitable for use in the detergent component of the present compositions include the alkoxylated surfactants previously described. Again, highly suitable nonionic surfactants of this type are ethoxylated primary or secondary $C_{9-15}$ alcohols having an average degree of ethoxylation from about 3 to about 9. Desirably, the total level of nonionic surfactant in the instant compositions is such as to provide a weight ratio of nonionic surfactant:anionic surfactant in the range from about 1:4 to about 4:1.

The addition of a water-soluble cationic surfactant to the present compositions has been found to be useful for improving the greasy stain removal performance. Suitable cationic surfactants are those having a critical micelle concentration for the pure material of at least 200 ppm and preferably at least 500 ppm specified at 30° C. and in distilled water. Literature values are taken where possible, especially surfact tension or conductimetric values—see Critical Micelle Concentrations of Aqueous Surfactant System, P. Mukerjee and K. J. Mysels, NSRDS—NBS 37 (1971).

A highly preferred group of cationic surfactants of this type have the general formula:

$$R^1{}_mR^2{}_{4-m}N\ Z$$

wherein $R^1$ is selected from $C_{8-20}$ alkyl, alkenyl and alkaryl groups; $R^2$ is selected from $C_{1-4}$ alkyl and benzyl groups; Z is an anion in number to give electrical neutrality; and m is 1, 2 or 3; provided that when m is 2 $R^1$ has less than 15 carbon atoms and when m is 3, $R^1$ has less than 9 carbon atoms.

Where m is equal to 1, it is preferred that $R^2$ is a methyl group. Preferred compositions of this monolong chain type include those in which $R^1$ is $C_{10}$ to $C_{16}$ alkyl group. Particularly preferred compositions of this class include $C_{12}$ alkyl trimethylammonium halide and $C_{14}$ alkyl trimethylammonium halide.

Where m is equal to 2, the $R^1$ chians should have less than 14 carbon atoms. Particularly preferred cationic materials of this calss include di-$C_8$ alkyldimethylammonium halide and di-$C_{10}$ alkyldimethylammonium halide materials.

Where m is equal to 3, the $R^1$ chains should be less than 9 carbon atoms in length. An example is trioctyl methyl ammonium chloride.

Another highly preferred group of cationic compounds have the general formula:

$R^1R^2{}_mR^3{}_{3-m}N^+A$ wherein $R^1$ represents a $C_{6-24}$ alkyl or alkenyl group or a $C_{6-12}$ alkaryl group, each $R^2$ independently represents a $(C_nH_{2n}O)_xH$ group where n is 2, 3 or 4 and x is from 1 to 14, the sum total of $C_nH_{2n}O$ groups in $R^2{}_m$ being from 1 to 14, each $R^3$ independently represents a $C_{1-12}$ alkyl or alkenyl group, an aryl group or a $C_{1-6}$ alkaryl group,. m is 1, 2 or 3, and A is an anion.

In this group of compounds, $R^1$ is selected from $C_{6-24}$ alkyl or alkenyl groups and $C_{6-12}$ alkaryl groups; $R^3$ is selected from $C_{1-12}$ alkyl or alkenyl groups and $C_{1-16}$ alkaryl groups. When m is 2, however, it is preferred that the sum total of carbon atoms in $R^1$ and $R^3{}_{3-m}$ is no more than about 20 with $R^1$ representing a $C_{8-18}$ alkyl or alkenyl group More preferably the sum total of carbon atoms in $R^1$ and $R^1{}_{3-m}$ is no more than about 17 with $R^1$ representing a $C_{10-16}$ alkyl or alkenyl group. When m is 1, it is again preferred that the sum total of carbon atoms in $R^1$ and $R^3{}_{3-m}$ is no more that about 17 with $R^1$ representing a $C_{10-16}$ alkyl or alkaryl group.

Additionally in this group of compounds, the total number of alkoxy radicals in polyalkoxy groups ($R^2{}_m$) directly attached to the cationic charge centre should be no more than 14. Preferably, the total number of such alkoxy groups is from 1 to 7 with each polyalkoxy group ($R^2$) independently containing from 1 to 7 alkoxy groups; more preferably, the total number of such alkoxy groups is from 1 to 5 with each polyalkoxy group ($R^2$) independently containing from 1 to 3 alkoxy groups. Especially preferred are cationic surfactants having the formula:

$$R^1\ (C_nH_{2n}OH)_m\ (CH_3)_{3m}\ N^+A$$

wherein $R^1$ is as defined immediately above, n is 2 or 3 and m is 1, 2 or 3.

Particularly preferred cationic surfactants of the class having m equal to 1 are dodecyl dimethyl hydroxyethyl ammonium salts, dodecyl dimethyl hydroxypropyl ammonium salts, myristyl dimethyl hydroxyethyl ammonium salts and dodecyl dimethyl dioxyethylenyl ammonium salts. When m is equal to 2, particularly preferred cationic surfactants are dodecyl dihydroxyethyl methyl ammonium salts, dodecyl dihydroxypropyl methyl ammonium salts, dodecyl dihydroxyethyl ethyl ammonium salts, myristyl dihydroxyethyl methyl ammonium salts, cetyl dihydroxyethyl methyl ammonium salts, stearyl dihydroxyethyl methyl ammonium salts, oleyldihydroxyethyl methyl ammonium salts, and dodecyl hydroxy ethyl hydroxypropyl methyl ammonium salts. When m is 3, particularly preferred cationic surfactants are dodecyl trihydroxyethyl ammonium salts, myristyl trihydroxyethyl ammonium salts, cetyl trihydroxyethyl ammonium salts, stearyl trihydroxyethyl ammonium salts, oleyl trihydroxy ethyl ammonium salts, dodecyl dihydroxyethyl hydroxypropyl ammonium salts and dodecyl trihydroxypropyl ammonium salts.

In the above, the usual inorganic salt counterions can be employed, for example, chlorides, bromides and borates. Salt counterions can also be selected from organic acid anions, however, such as the anions derived from organic sulphonic acids and from sulphuric acid esters. A preferred example of an organic acid anion is a $C_{6-12}$ alkaryl sulphonate.

Of all the above cationic surfactants, especially preferred are dodecyl dimethyl hydroxyethyl ammonium salts and dodecyl dihydroxyethyl methyl ammonium salts.

Additional preferred cationic surfactants are fully disclosed in British patent application No. 79-25946 and incorporated herein by reference.

The above water-soluble cationic surfactants can be employed in nonionic/cationic surfactant mixtures in a weight ratio of from about 10:6 to about 20:1, more preferably from about 10:2 to about 10:6, and particularly from about 10:3 to 10:5.

Other optional ingredients which can be added to the present composition either as part of the additives or as a separate particulate admixture include surfactants other than the nonionic and cationic surfactants specified hereinbefore, suds modifiers, chelating agents, anti-redeposition and soil suspending agents, optical brighteners, bactericides, anti-tarnish agents, enzymatic materials, fabric softeners, antistatic agents, perfumes, antioxidants and bleach catalysts.

U.S. Pat. No. 3,933,672 issued Jan. 20, 1976, to Bartollota et al., incorporated herein by reference, discloses a silicone suds controlling agent. The silicone material can be represented by alkylated polysiloxane materials such as silica aerogels and xerogels and hydrophobic silicas of various types. The silicone material can be described as siloxane having the formula:

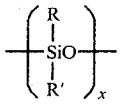

wherein x is from about 20 to about 2,000 and R and R′ are each alkyl or aryl groups, especially methyl, ethyl, propyl, butyl and phenyl. The polydimethylsiloxanes (R and R′ are methyl) having a molecular weight within the range of from about 200 to about 2,000,000, and higher, are all useful as suds controlling agents. Additional suitable silicone materials wherein the side chain groups R and R′ are alkyl, aryl, or mixed alkyl or aryl hydrocarbyl groups exhibit useful suds controlling properties. Examples of the like ingredients include diethyl-, dipropyl-, dibutyl-, methyl-, ethyl-, phenylmethylpolysiloxanes and the like. Additional useful silicone suds controlling agents can be represented by a mixture of an alkylated siloxane, as referred to hereinbefore, and solid silica. Such mixtures are prepared by affixing the silicone to the surface of the solid silica. A preferred silicone suds controlling agent is represented by a hydrophobic silanated (most preferably trimethylsilanated) silica having a particle size in the range from about 10 millimicrons to 20 millimicrons and a specific surface area above about 50 $m^2/g$. intimately admixed with dimethyl silicone fluid having a molecular weight in the range from about 500 to about 200,000 at a weight ratio of silicone to silanated silica of from about 1:1 to about 1:2. The silicone suds suppressing agent is advantageously releasably incorporated in a water-soluble or water-dispersible, substantially non-surface-active detergent-impermeable carrier.

Particularly useful suds suppressors are the self-emulsifying silicone suds suppressors, described in German Patent Application DTOS No. 2,646,126 published Apr. 28, 1977 and incorporated herein by reference. An example of such a compound is DS-544, commercially available from Dow Corning, which is a siloxane/-glycol copolymer.

Suds modifiers as described above are used at levels of up to approximately 5%, preferably from 0.1 to 2% by weight of the nonionic surfactant. They can be incorporated into the particulates of the present invention or can be formed into separate particulates that can then be mixed with the particulates of the invention. The incorporation of the suds modifiers as separate particulates also permits the inclusion therein of other suds controlling materials such as $C_{20}$–$C_{24}$ fatty acids, microcrystalline waxes and high MWt copolymers of ethylene oxide and propylene oxide which would otherwise adversely affect the dispersibility of the matrix. Techniques for forming such suds modifying particulates are disclosed in the previously mentioned Bartolotta et al U.S. Pat. No. 3,933,672.

The detergent compositions of the invention can also contain from about 5% to about 93.9% of detergency builder, preferably from about 20% to about 70% thereof.

Suitable detergent builder salts useful herein can be of the polyvalent inorganic and polyvalent organic types, or mixtures thereof. Non-limiting examples of suitable water-soluble, inorganic alkaline detergent builder salts include the alkali metal carbonates, borates, phosphates, polyphosphates, tripolyphosphates and bicarbonates.

Examples of suitable organic alkaline detergency builder salts are:

(1) water-soluble amino polyacetates, e.g. sodium and potassium ethylendiaminetetraacetates, nitrilotriacetates, and N-(2-hydroxyethyl)nitrilodiacetates;

(2) water-soluble salts of phytic acid, e.g. sodium and potassium phytates;

(3) water-soluble polyphosphonates, including, sodium, potassium and lithium salts of ethane-1-hydroxy-1,1-diphosphonic acid; sodium, potassium and lithium salts of methylenediphosphonic acid and the like.

(4) water-soluble polycarboxylates such as the salts of lactic acid, glycollic acid and ether derivatives thereof as disclosed in Belgian Patent Nos. 821,368, 821,369 and 821,370; succinic acid, malonic acid, (ethylenedioxy) diacetic acid, maleic acid, diglycollic acid, tartaric acid, tartronic acid and fumaric acid; citric acid, aconitic acid, citraconic acid, carboxymethyloxysuccinic acid, lactoxysuccinic acid, and 2-oxy-1,1,3-propane tricarboxylic acid; oxydisuccinic acid, 1,1,2,2-ethane tetracarboxylic acid, 1,1,3,3-propane tetracarboxylic acid and 1,1,2,3-propane tetracarboxylic acid; cyclopentane-cis, cis, cis-tetracarboxylic acid, cyclopentadienide pentacarboxylic acid, 2,3,4,5-tetrahydrofuran-cis, cis, cis-tetracarboxylic acid, 2,5-tetrahydrofuran-cis-dicarboxylic acid, 1,2,3,4,5,6-hexane-hexacarboxylic acid, mellitic acid, pyromellitic acid and the phthalic acid derivatives disclosed in British Pat. No. 1,425,343.

Mixtures of organic and/or inorganic builders can be used herein. One such mixture of builders is disclosed in Canadian Patent No. 755,038, e.g. a ternary mixture of sdium tripolyphosphate, trisodum nitrilotriacetate, and trisodium ethane-1-hydroxy-1,1-diphosphate.

A further class of builder salts is the insoluble alumino silicate type which functions by cation exchange to remove polyvalent mineral hardness and heavy metal ions from solution. A preferred builder of this type has the formulation $Na_z(AlO_2)_z(SiO_2)_y.xH_2O$ wherein z and y are integers of at least 6, the molar ratio of z to y is in the range from 1.0 to about 0.5 and x is an integer from about 15 to about 264. Compositions incorporating builder salts of this type form the subject of British patent specification No. 1,429,143 published Mar. 24, 1976, German Patent Application No. OLS 2,433,485 published Feb. 6, 1975, and OLS 2,525,778 published Jan. 2, 1976, the disclosures of which are incorporated herein by reference.

The detergent compositions of the invention can also be supplemented by bleaches, especially sodium perborate tetrahydrate or sodium percarbonate at levels from about 5% to about 93.9%. The compositions also preferably include from about 0.05% to about 0.6% (acid basis), preferably from about 0.06% to about 0.3% of aminopolyphosphonic acid, or salt thereof, having the general formula:

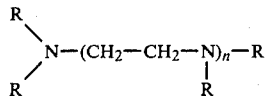

wherein n is an integral number from 0 to 3, and each R is individually hydrogen or $CH_2PO_3H_2$ provided that at least half of the radicals represented by R are $CH_2PO_3H_2$. Preferred aminopolyphosphonic acids are selected from nitrilotri(methylenephosphonic acid), ethylene-diaminetetra(methylenephosphonic acid), diethylenetriamine(pentamethylenephosphonic acid), and mixtures thereof.

An alkali metal, or alkaline earth metal, silicate can also be present. The alkali metal silicate is preferably from about 3% to about 8%. Suitable silicate solids have a molar ratio of $SiO_2$/alkali metal$_2$O in the range from about 1.0 to about 3.3, more preferably from 1.5 to 2.0. Other suitable ingredients include soil-suspending agents such as the water-soluble salts of carboxymethyl cellulose and of methyl vinylether/maleic anhydride copolymer, nonionic cellulose materials such as hydroxyethyl cellulose, and polyethylene glycols.

In the Examples which follow, the abbreviations used have the following designation:

LAS: Linear $C_{12}$ alkyl benzene sulphonate

TAS: Sodium tallow alcohol sulfate $TlAE_n$: Tallow alcohol ethoxylated with n moles of ethylene oxide per mole of alcohol CTMAC: Coconut trimethyl ammonium chloride CDMAC: Coconut alkyl dihydroxyethyl methyl ammonium chloride Dobanol 45-E-7: A $C_{14-15}$ oxo-alcohol with 7 moles of ethylene oxide, marketed by Shell Dobanol 45-E-4: A $C_{14-15}$ oxo alcohol with 4 moles of ethylene oxide, marketed by Shell Dobanol 91-E-3: A $C_{9-11}$ oxo alcohol with 4 moles of ethylene oxide, marketed by Shell TAED: Tetraacetyl ethylene diamine AOBS: Sodium p-acetoxy benzene sulphonate TAHD: Tetraacetyl hexamethylene diamine Imvite: Sodium montmorillonite marketed by IMV, Nevada U.S.A.

ZPT: Zinc phthalocyanine tetrasulphonate

Silicate: Sodium silicate having an $SiO_2$:$Na_2O$ ratio of 1.6.

Wax: Microcrystalline wax-Witcodur 272 M.pt 87° C.

Silicone Prill: Comprising 0.14 parts by weight of an 85:15 by weight mixture of silanated silica and silicone, granulated with 1.3 parts of sodium tripolyphosphate, and 0.56 parts of tallow alcohol condensed with 25 molar proportions of ethylene oxide Gantrez AN119: Trade Name for maleic anhydride/vinyl methyl ether copolymer, believed to to have an average molecular weight of about 240,000, marketed by GAF. This was prehydrolysed with NaOH before addition.

Brightener: Disodium 4,4'-bis(2-morpholino-4-anilino-s-triazin-6-ylamino)stilbene-2:2'-disulphonate.

Dequest 2060: Trade Name for diethylene triamine penta(methylene phosphonic acid), marketed by Monsanto.

Dequest 2041: Trade Name for ethylenediamine tetra (methylene phosphonic acid), marketed by Monsanto.

The present invention is illustrated by the following examples:

EXAMPLES I–VI

The following additive compositions are each prepared by admixing the particulate solid components and nonionic surfactant at a temperature of about 45° to form a homogeneous, friable matrix which is then extruded through an XTRUDER (Registered Trade Mark) EXKS-1 in radial discharge mode.

| | Examples | | | | | |
|---|---|---|---|---|---|---|
| | I | II | III | IV | V | VI |
| TAED | — | 80 | — | — | — | 87 |
| AOBS | — | — | 50 | — | — | — |
| TAHD | — | — | — | — | 70 | — |
| ZPT | 1 | — | — | — | — | — |
| Sodium tripolyphosphate (Anhydrous) | 87 | — | — | — | — | — |
| Imvite | — | — | 34 | — | — | — |
| Dequest 2060 | — | — | — | — | 5 | — |
| Dequest 2041 | — | 6 | — | — | — | — |
| LAS (spray dried) | — | — | — | 39 | — | — |
| Sodium perborate tetrahydrate (average particle size ~50μ) | — | — | — | 50 | — | — |
| Magnesium sulphate | — | — | — | 1 | — | — |
| Gantrez AN119 | — | — | — | — | 10 | — |
| $TAE_{11}$ | 12 | 14 | 16 | 10 | 15 | 13 |

The above products are non-bleeding, free-flowing granular compositions having high granule strength, low dust and low moisture pick-up on storage at 32° and 80% relative humidity, and they have excellent storage stability and rapid dispersibility in aqueous detergent media.

EXAMPLES VII–XII

The following detergent compositions are prepared by dry-mixing the additive compositions of Examples I to VI and where appropriate, the sodium perborate tetrahydrate, silicone prill and enzyme with auxiliary granular, spray-dried mixtures containing all remaining components apart from nonionic surfactant, which is added as a final spray-on.

| | Examples | | | | | |
|---|---|---|---|---|---|---|
| | VII | VIII | IX | X | XI | XII |
| LAS | 6 | 12 | — | 2 | 8 | 7 |
| TAS | 2 | — | 10 | — | — | 2 |
| CTMAC | — | — | 3 | — | 2 | — |
| CDMAC | — | — | — | 1 | — | — |
| Dobanol 45-E-4 | — | — | — | 4 | — | — |
| Dobanol 45-E-7 | — | — | 5 | 8 | 5 | — |
| Dobanol 91-E-3 | — | 2 | — | — | — | — |
| Sodium tripolyphosphate | 33 | 40 | 30 | 60 | 45 | 24 |
| Silicate | 10 | 8 | — | — | 9 | 6 |
| Dequest 2041 | — | — | — | — | 0.3 | 0.1 |
| Dequest 2060 | 0.5 | — | — | — | — | — |
| Wax | — | — | — | 1 | 2 | — |
| Gantrez AN119 | — | — | 0.5 | — | 0.4 | 1 |

-continued

| | Examples | | | | | |
|---|---|---|---|---|---|---|
| | VII | VIII | IX | X | XI | XII |
| Brightener | 0.5 | — | 0.5 | — | 0.3 | 0.3 |
| Additive I | 2 | — | — | — | — | — |
| Additive II | — | 5 | — | — | — | — |
| Additive III | — | — | 10 | — | — | — |
| Additive IV | — | — | — | 7 | — | — |
| Additive V | — | — | — | — | 12 | — |
| Additive VI | 2 | — | — | — | — | 2 |
| Sodium perborate tetrahydrate (average particle size ~300μ) | 30 | 25 | 25 | 15 | 10 | 22 |
| Akalaze enzyme | 1 | — | — | — | — | 1 |
| Silicone prill | 1 | 2 | 2 | — | — | 1 |
| Sodium sulphate, moisture, miscellaneous | | | To 100 | | | |

The above products are free-flowing granular compositions having excellent detergency performance on bleachable stains and displaying excellent physical and chemical storage characteristics.

EXAMPLES XIII to XVIII

The following additive compositions are each prepared by spraying the nonionic surfactant onto the particulate solid components (other than surface coating agent) at a temperature of about 40° C. to form a homogeneous friable mass which is then extruded through an XTRUDER (RTM) EXD-100 in radial discharge mode using 1.2 mm screens. The extrudate is then coated with the surface-coating agent as specified. Finally the additive compositions XIII to XVIII are incorporated in the detergent compositions of Examples VII to XII replacing Additives I to VI respectively. The numbers are parts by weight.

| | Examples | | | | | |
|---|---|---|---|---|---|---|
| | XIII | XIV | XV | XVI | XVII | XVIII |
| Extrudate | | | | | | |
| TAED | 87 | 80 | 76 | 76 | 80 | 78 |
| Dequest 2041 | — | 6 | — | 7 | 6 | — |
| Dequest 2060 | — | — | 5 | — | — | 5 |
| $TAE_{11}$ | 13 | 14 | 15 | 12 | 12 | 14 |
| Magnesium sulphate | — | — | 2 | — | — | 2 |
| Gantrez AN114 | — | — | 2 | 5 | — | 1 |
| Surface Coating Agent | | | | | | |
| Magnesium silicate ($MgO:SiO_2$ = 0.3125) | 2.0 | 1.5 | — | — | — | — |
| Imvite | — | — | 2.5 | 1.8 | — | — |
| Zeolite A | — | — | — | — | 2.0 | 1.4 |

The above products are non-bleeding, free-flowing granular compositions having high granule strength, low dust and low moisture pick-up on storage at 32° and 80% relative humidity, and they have excellent storage stability and rapid dispersibility in aqueous detergent media.

What is claimed is:

1. A detergent additive composition in the form of an extrudate comprising by weight thereof:

(a) from about 84% to about 90% of particulate, infusible solids having a particle size distribution such that at least about 50% thereof passes a 250 micrometer screen and comprising storage-sensitive detergent additive material, and (b) from about 10% to about 16% of ethoxylated nonionic surfactant melting in the range from about 20° C. to about 60° C., the composition being prepared by mixing the particulate infusible solids and ethoxylated nonionic surfactant in liquid form to form a substantially homogeneous friable mass, and mechanically extruding the friable mass by means of a screw with radial discharge through an apertured screen to form extrudate in the form of elongate particles having an average lateral dimension in the range from about 0.5 millimeters to about 2 millimeters, and an average longitudinal dimension in the range from about 1 to about 6 millimeters.

2. A composition according to claim 1 wherein the ethoxylated nonionic surfactant has a melting point in the range from about 22° C. to about 40° C.

3. A composition according to claim 1 wherein the storage-sensitive detergent additive material is a unifunctional or multifunctional material selected from the group consisting of bleaching auxiliaries, photoactivators, fluorescers, dyes, perfumes, germicides, enzymes, suds controllers and fabric conditioners.

4. A composition according to claim 3 wherein the storage-sensitive detergent additive material is an organic peroxyacid bleach precursor.

5. A composition according to claim 3 wherein the storage-sensitive detergent additive material is a porphine having the general formula:

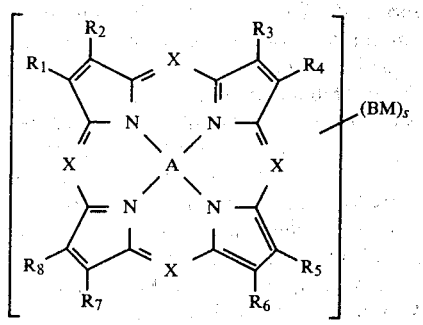

wherein each X is (=N—) or (=CY—), and the total number of (=N—) groups is 0, 1, 2, 3 or 4; wherein each Y, independently, is hydrogen or meso substituted alkyl, cycloalkyl, aralkyl, aryl, alkaryl or heteroaryl, wherein each R, independently, is hydrogen or pyrrole substituted alkyl, cycloalkyl, aralkyl, aryl, alkaryl or heteroaryl, or wherein adjacent pairs of R's are joined together with ortho-arylene groups to form pyrrole substituted alicyclic or heterocyclic rings; wherein A is 2(H) atoms bonded to diagonally opposite nitrogen atoms, or Zn(II), Cd(II), Mg(II), Ca(II), Al(III), Sc(III), or Sn(IV); wherein B is an anionic, nonionic or cationic solubilizing group substituted into Y or R; wherein M is a counterion to the solubilizing groups; and wherein s is the number of solubilizing groups; wherein, when B is cationic, M is an anion and s is from 1 to 8; when B is nonionic, B is polyethoxylate, M is zero, s is from 1 to 8, and the number of condensed ethylene oxide molecules per porphine molecule is from 8 to 50; when B is anionic and proximate, M is cationic and s is from 2 to 8; when B is anionic and remote, M is cationic and s is from 2 to 8; and when B is sulphonate the number of sulphonate groups is no greater than the number of aromatic and heterocyclic substituent groups.

6. A composition according to claim 1 wherein the storage-sensitive detergent additive material is in intimate mixture with a particulate dispersant selected from the group consisting of water-insoluble natural or synthetic silica or silicates, water-soluble inorganic salt materials, water-soluble organic polyacids or salts thereof having a melting point (anhydrous) of at least 100° C. and mixtures thereof.

7. A composition according to claim 1 comprising from about 1% to about 3% by weight thereof of a coating agent on the surface of the extrudate, the coating agent being selected from water-insoluble natural or synthetic silica or silicates.

8. A composition according to claim 1 wherein the particles of extrudate have an average lateral dimension in the range from about 840 micrometers to about 1.4 millimeters and an average longitudinal dimension in the range from about 1.5 to about 3 millimeters.

9. A granular detergent composition comprising: from about 40% to about 99.9% of spray-dried base powder comprising (i) from about 1% to about 20% of organic surfactant selected from anionic, zwitterionic and ampholytic surfactants and mixtures thereof, (ii) from about 5% to about 93.9% of detergency builder, and (iii) from about 5% to about 18% moisture, and from about 0.1% to about 20% of a detergent additive composition in the form of an extrudate comprising by weight thereof:

(a) from about 84% to about 90% of particulate, infusible solids having a particle size distribution such that at least about 50% thereof passes a 250 micrometer screen and comprising storage-sensitive detergent additive material, and (b) from about 10% to about 16% of ethoxylated nonionic surfactant melting in the range from about 20° C. to about 60° C., the composition being prepared by mixing the particulate infusible solids and ethoxylated nonionic surfactant in liquid form to form a substantially homogeneous friable mass, and mechanically extruding the friable mass by means of a screw with radial discharge through an apertured screen to form extrudate in the form of elongate particles having an average lateral dimension in the range from about 0.5 millimeters to about 2 millimeters, and an average longitudinal dimension in the range from about 1 to about 6 millimeters.

10. A composition according to claim 9 wherein the ethoxylated nonionic surfactant has a melting point in the range from about 22° C. to about 40° C.

11. A composition according to claim 9 wherein the storage-sensitive detergent additive material is a unifunctional or multifunctional material selected from the group consisting of bleaching auxiliaries, photoactivators, fluorescers, dyes, perfumes, germicides, enzymes, suds controllers and fabric conditioners.

12. A composition according to claim 11 wherein the storage-sensitive detergent additive material is an organic peroxyacid bleach precursor.

13. A composition according to claim 11 wherein the storage-sensitive detergent additive material is a porphine having the general formula:

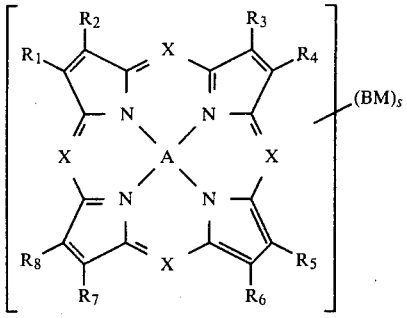

wherein each X is (=N—) or (=CY—), and the total number of (=N—) groups is 0, 1, 2, 3 or 4; wherein each Y, independently, is hydrogen or meso substituted alkyl, cycloalkyl, aralkyl, aryl, alkaryl or heteroaryl, wherein each R, independently, is hydrogen or pyrrole substituted alkyl, cycloalkyl, aralkyl, aryl, alkaryl or heterorarly, or wherein adjacent pairs of R's are joined together with ortho-arylene groups to form pyrrole substituted alicyclic or heterocyclic rings; wherein A is 2(H) atoms bonded to diagonally opposite nitrogen atoms, or Zn(II), Cd(II), Mg(II), Ca(II), Al(III), Sc(III), or Sn(IV); wherein B is an anionic, nonionic or cationic solubilizing group substituted into Y or R; wherein M is a counterion to the solubilizing groups; and wherein s is the number of solubilizing groups; wherein, when B is cationic, M is an anion and s is from 1 to 8; when B is nonionic, B is polyethoxylate, M is zero, s is from 1 to 8, and the number of condensed ethylene oxide molecules per porphine molecule is from 8 to 50; when B is anionic and proximate, M is cationic and s is from 2 to 8; when B is anionic and remote, M is cationic and s is from 2 to 8; and when B is sulphonate the number of sulphonate groups is no greater than the number of aromatic and heterocyclic substituent groups.

14. A composition according to claim 9 wherein the storage-sensitive detergent additive material is in intimate mixture with a particulate dispersant selected from the group consisting of water-insoluble natural or synthetic silica or silicates, water-soluble inorganic salt materials, water-soluble organic polyacids or salts thereof having a melting point (anhydrous) of at least 100° C. and mixtures thereof.

15. A composition according to claim 9 comprising from about 1% to about 3% by weight thereof of a coating agent on the surface of the extrudate, the coating agent being selected from water-insoluble natural or synthetic silica or silicates.

16. A composition according to claim 9 wherein the particles of extrudate have an average lateral dimension in the range from about 840 micrometers to 1.4 millimeters and an average longitudinal dimension in the range from about 1.5 to about 3 millimeters.

17. A composition according to claim 12 or 13 additionally comprising up to about 25% of ethoxylated nonionic surfactant in intimate mixture with the spray-dried powder and detergent addition composition, and up to about 35% of peroxysalt bleaching agent.

* * * * *